US010166583B2

(12) United States Patent
Pehle et al.

(10) Patent No.: US 10,166,583 B2
(45) Date of Patent: Jan. 1, 2019

(54) PROCESS FOR HOT-ROLLING METALLIC HOLLOW BODIES AND CORRESPONDING HOT-ROLLING MILL

(75) Inventors: Hans-Joachim Pehle, Moenchengladbach (DE); Peter Thieven, Moenchengladbach (DE)

(73) Assignee: SMS group GmbH, Duesseldorf (DE)

( * ) Notice: Subject to any disclaimer, the term of this patent is extended or adjusted under 35 U.S.C. 154(b) by 198 days.

(21) Appl. No.: 13/806,802

(22) PCT Filed: Jun. 28, 2011

(86) PCT No.: PCT/DE2011/001411

§ 371 (c)(1),
(2), (4) Date: Dec. 24, 2012

(87) PCT Pub. No.: WO2012/022284

PCT Pub. Date: Feb. 23, 2012

(65) Prior Publication Data

US 2013/0098128 A1 Apr. 25, 2013

(30) Foreign Application Priority Data

Jun. 28, 2010 (DE) ..... 10 2010 025 288
Oct. 28, 2010 (DE) ..... 10 2010 049 645

(51) Int. Cl.
*B21B 25/04* (2006.01)
*B21B 19/06* (2006.01)
*B21B 23/00* (2006.01)

(52) U.S. Cl.
CPC ..... *B21B 25/04* (2013.01); *B21B 19/06* (2013.01); *B21B 23/00* (2013.01)

(58) Field of Classification Search
CPC ..... B21B 25/04; B21B 19/06; B21B 23/00; B21B 37/18; C10N 2240/40; C10N 2240/402; C10N 2240/403; C10N 2240/404; C10N 2240/405; C10N 2240/406; C10N 2040/20; C10N 2040/22; C10N 2040/24
USPC ..... 72/41, 42, 43, 44; 184/17, 99
See application file for complete search history.

(56) References Cited

U.S. PATENT DOCUMENTS 2,115,210 A * 4/1938 Mulholland ..... 451/514
2,706,850 A * 4/1955 Lambert ..... B21C 23/32 29/423
2,723,705 A * 11/1955 Collins ..... B29C 53/607 138/140

(Continued)

FOREIGN PATENT DOCUMENTS

DE 100 44 111 4/2002
EP 0 076 170 4/1983

(Continued)

OTHER PUBLICATIONS

International Search Report of PCT/DE2011/001411, dated May 15, 2012.

*Primary Examiner* — Teresa M Ekiert
*Assistant Examiner* — Gregory Swiatocha
(74) *Attorney, Agent, or Firm* — Collard & Roe, P.C.

(57) ABSTRACT

In order to optimize the lubrication of a rolling rod in a process for hot-rolling metallic, elongate hollow bodies (21) by means of the rolling rod (2), which is arranged in the hollow body and to which lubricant is applied before the hot-rolling operation, the lubricant is applied to the rolling rod in solid form.

33 Claims, 11 Drawing Sheets

(56) References Cited

Figure 1:
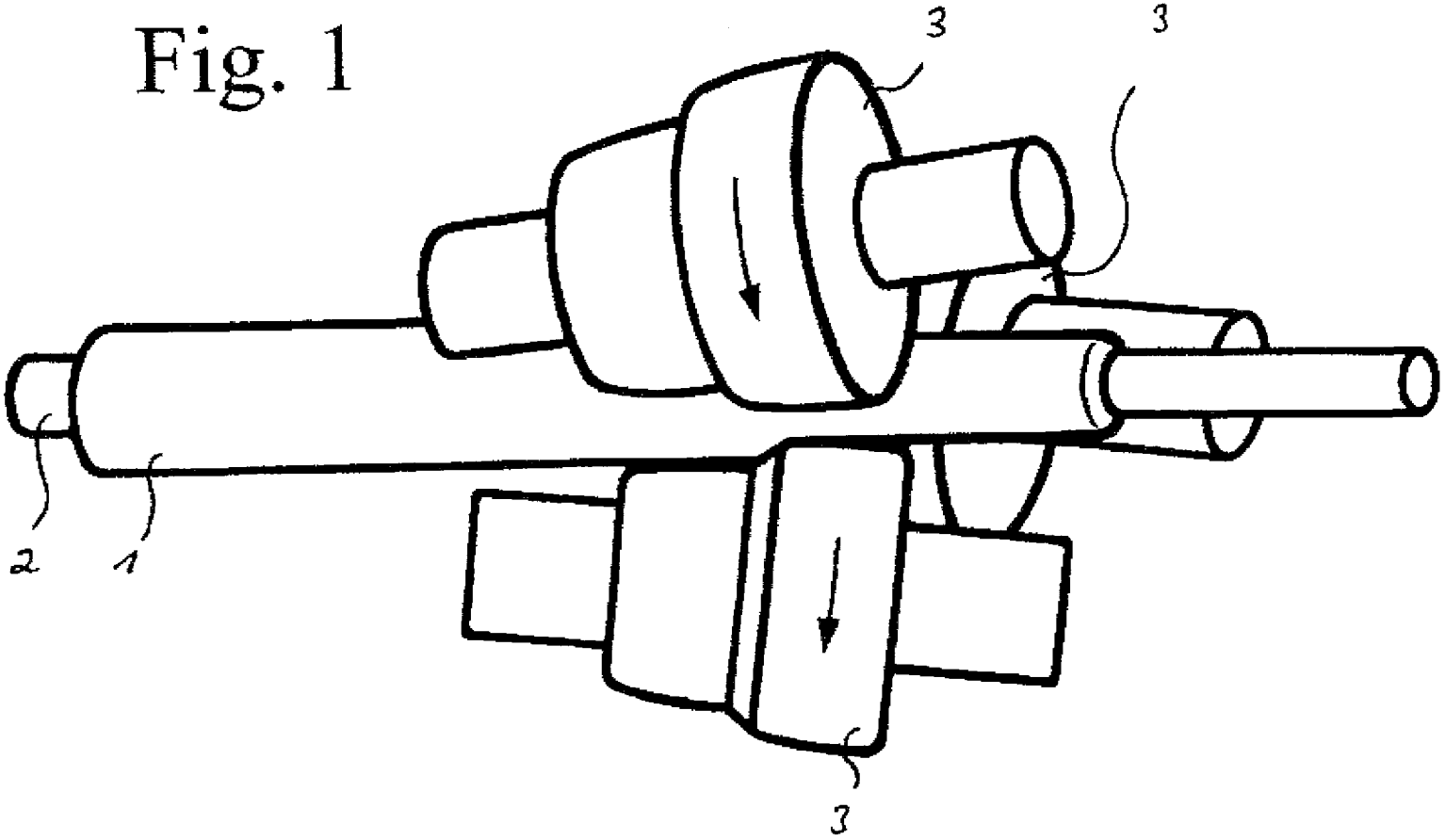

U.S. PATENT DOCUMENTS 2,738,062 A * 3/1956 Edgecombe ..... B21C 23/32 225/104
2,937,436 A * 5/1960 Butler ..... B65H 81/08 228/145
2,984,286 A * 5/1961 Copenhefer ..... D04H 3/02 156/157
3,021,594 A * 2/1962 Segal ..... C10M 7/00 29/424
3,127,015 A * 3/1964 Schieren ..... B21C 23/32 29/424
3,255,621 A * 6/1966 Ohsol ..... 72/42
3,488,985 A * 1/1970 Peterson ..... B21C 23/32 72/42
4,068,619 A * 1/1978 Batts ..... B05C 1/04 118/103
4,201,070 A * 5/1980 Seaton et al. ..... 72/42
4,575,430 A * 3/1986 Periard et al. ..... 508/113
5,099,667 A * 3/1992 Schmitter et al. ..... 72/44
5,225,021 A * 7/1993 Lona ..... B29C 37/0032 156/171
5,301,960 A * 4/1994 Meyer et al. ..... 277/537
5,305,853 A * 4/1994 Ross et al. ..... 184/3.2
5,492,639 A 2/1996 Schneider et al.
6,210,806 B1 * 4/2001 Hidaka ..... C21D 6/002 428/469
7,308,812 B2 12/2007 Iida et al.
7,722,922 B2 * 5/2010 Yamaguchi ..... B22F 1/0074 427/201
8,789,254 B2 * 7/2014 Minisandram ..... B21C 23/32 29/424
2004/0144643 A1 7/2004 Wu et al.
2007/0137937 A1 * 6/2007 Citro ..... 184/17
2008/0083254 A1 * 4/2008 Nakaike et al. ..... 72/97
2009/0084151 A1 * 4/2009 Hidaka ..... B21B 23/00 72/97
2009/0293569 A1 12/2009 Saito et al.
2011/0302978 A1 * 12/2011 Oppenheimer et al. ..... 72/41

FOREIGN PATENT DOCUMENTS

EP 0076170 A1 * 4/1983
EP 0076170 A1 * 4/1983 ..... B05B 5/14
EP 0 116 882 8/1984
EP 1 775 038 4/2007
GB 2 022 471 12/1979
JP 2000-246312 9/2000

* cited by examiner

PROCESS FOR HOT-ROLLING METALLIC HOLLOW BODIES AND CORRESPONDING HOT-ROLLING MILL

CROSS REFERENCE TO RELATED APPLICATIONS

This application is the National Stage of PCT/DE2011/001411 filed on Jun. 28, 2011, which claims priority under 35 U.S.C. § 119 of German Application Nos. 10 2010 025 288.3 filed on Jun. 28, 2010, and 10 2010 049 645.6 filed on Oct. 28, 2010, the disclosures of which are incorporated by reference. The international application under PCT article 21(2) was not published in English.

The invention relates to a method for hot-rolling of metallic hollow bodies as well as a corresponding hot-rolling mill. In particular, the invention relates to a method for hot-rolling of metallic, elongated hollow bodies by means of a rolling rod disposed in the hollow body, to which lubricant is applied before the hot-rolling process. Also, the invention relates to a hot-rolling mill for hot-rolling of metallic, elongated hollow bodies by means of a rolling rod disposed in the hollow body, having a hot-rolling device as well as having a lubricant application station disposed ahead of it.

In this connection, it should be particularly emphasized that the present invention does not relate to chrome-plating and subsequent polishing of roller rods, as is disclosed, for example, in JP 2000-246312 A and actually has already been known significantly longer, and which, of course, also lowers the friction coefficients of the roller rods, particularly by means of the polishing process. Such a chrome layer, however, remains on the rolling rod for a plurality of rolling processes, while related lubricant layers are applied to the rolling rod before every rolling process, so that lubricant must therefore be viewed as a true consumable in such rolling processes.

Such methods and apparatuses are known, for example, from DE 100 44 111 A1 as well as from EP 0 076 170 A1, whereby DE 100 44 111 A1 discloses a method for the lubrication of forming dies or molds, particularly also of hot-forging dies, in which a powder consisting of graphite or a powder containing graphite is electrically or electrostatically charged and subsequently applied to the tool in question, with the aid of an electrical field. Something similar is also disclosed by EP 0 076 170 A1, whereby here, a liquid, if necessary with lubricant particles suspended in the liquid, as is also disclosed in U.S. Pat. No. 5,492,639, is applied, while according to DE 100 44 111 A1, the application takes place by way of a solid but powder-form lubricant, in other words also a fluidic lubricant. EP 1 775 038 B1 and US 2009/0293569 also disclose the use of a powder-form, i.e. fluidic or flowable lubricant, but this is obviously applied without the use of an electrical field, with the aid of a carrier gas stream. In this connection, a lubricant layer can be applied to the inside of the hollow block to be processed, in other words the work piece, on the one hand. Likewise, a corresponding lubrication can also be provided on the rolling rod, in other words on a tool, whereby graphite-based lubricants, for example with the addition of a plastic-based organic binder or mica-based lubricant having an organic binder on the basis of borates can be used as lubricants.

Solid lubricants for rolling rods are disclosed, for example also in U.S. Pat. No. 4,57.5,430, whereby there, application of the solid lubricant to the rolling rod takes place by way of abrasive or melting processes. While the latter processes lead directly to a liquid application of the lubricant, as was already explained above, the former processes as such apparently cause an application of the lubricant in solid form, to a corresponding rolling rod, at first glance. However, the abrasive transfer of lubricant brings about the result, on a microscopic scale, that the apparently solid structure of the abrasively applied lubricant is broken up and that a solid structure only forms again after application to the rolling rod.

All these methods therefore have in common that during rubbing off or abrasive application or even during spraying on—whether this involves a dry powder or a liquid—the lubricant thickness can be controlled and restricted to a minimum only with great difficulty, because as little time as possible should elapse for application of the lubricant, so that the rolling rod, in each instance, cools off as little as possible, and is available for the next rolling process as quickly as possible, and that the local lubricant thickness distribution can be controlled only with difficulty by means of such spraying processes.

It is the task of the present invention to provide a remedy here.

As a solution, on the one hand, a method for hot-rolling of metallic, elongated hollow bodies by means of a rolling rod disposed in the hollow body, to which lubricant is applied before the hot-rolling process, is proposed, whereby this method is characterized in that the lubricant is applied to the rolling rod in solid form.

In deviation from lubricant that is applied fluidically, as a powder, paste, suspension, or in some other liquid form, application in solid form, for example in the form of films, sheets, or shaped bodies, allows more rapid and operationally reliable application, particularly since the risks that lubricant will fall off again, in uncontrolled manner, or will be removed again by means of almost explosion-like evaporation processes of a carrier fluid, can be reduced to a minimum. In this connection, it should be emphasized that a "solid form" assumes a macroscopic and, within certain limits, inherently stable form of the lubricant, which differs from fluidic, in other words flowable or spreadable states, which can flow, as a multi-particle or multi-body mass stream, whether in the case of abrasive or ablative processes, in a power stream, in a suspension, or, as whole, as a liquid, in that the characteristic dimensions of the lubricant present in solid form are significantly greater, at the time when the lubricant is applied to the rolling rod, than the final layer thickness. In this regard, films, sheets, or other thin surface structures, but also rods will be viewed as solid, since these, particularly in one dimension in the case of rods and the like or in two dimensions in the case of sheets or films, are significantly greater than the layer thickness, namely than the rod diameter or than the thickness of the films or sheets, while dry powders can flow and are not solid as such. The same holds true for pastes, which generally start to flow immediately, particularly at the temperatures at which the rolling rods are or must be lubricated, and therefore demonstrate the same disadvantages as sprayable liquids, and for lubricants that are applied to the rolling rod by means of abrasive processes or ablation, because there, as well, the solid structure is locally broken up during abrasive application, and characteristic dimensions can be found in minute lubricant particles or droplets, which are individually transferred from one surface to the other, by means of the abrasive application.

Preferably, the lubricant is at first prefabricated in a first method step, and subsequently, the prefabricated lubricant is applied to the rolling rod in a second method step. In this way, it is possible to work with the related precision during prefabrication, in particular without the rolling process itself or a work path of the rolling rod and its cycle speed or components of the rolling train or the temperatures prevailing there impairing this prefabrication. This particularly holds true if the two method steps are not synchronized, so that prefabrication can take place even independent, in terms of time, from the application or affixation to the rolling rod.

Accordingly, independent of the other characteristics of the present invention, a hot-rolling mill for hot-rolling of metallic, elongated hollow bodies by means of a rolling rod disposed in the hollow body, having a hot-rolling device as well as having a lubricant application station disposed ahead of it, is proposed, which is characterized by a lubricant fabrication station that is disposed separate from the lubricant application station. This allows, for the first time, targeted application of lubricant outside of a cycle that takes place during production or during rolling, through which process the rolling rods pass, and which is ultimately predetermined by the cycle speed of this cycle, whereby already for energy reasons and also for reasons of acquisition costs, it is the goal to allow the rolling rods to rotate at the shortest possible cycle frequency and, if possible, not to cool off. If necessary, it is also possible to have multiple lubricant fabrication stations run parallel, if the cycle frequency of the rolling rods is so great that one lubricant fabrication station cannot prefabricate the lubricant quickly enough.

Such non-synchronized prefabrication is particularly advantageous if the lubricant is applied to the rolling rod in solid form. For example, films or strips can be correspondingly prepared as rolled goods, in order to subsequently wrap them onto the rolling rods as part of the ongoing production process. Likewise, sheets or films can be cut to size, in preparation, or also—possibly only locally, for example in the region of or shortly behind a rolling rod tip—prepared in multiple layers, in order to subsequently lay this around a rolling rod, quickly and in operationally reliable manner, during the ongoing production process. On the other hand, however, lubricant, whether in solid or in non-solid form, can first be applied to a matrix, in a prefabricating method step, and subsequently applied to the rolling rod in the second method step, whereby it is certainly possible, during the second method step, for the lubricant to be solid or not solid, as long as it remains stable in the matrix to a sufficient extent, until it is transferred to the rolling rod.

Independent of the other characteristics of the present invention, the invention accordingly also proposes a method for hot-rolling of metallic, elongated hollow bodies using a rolling rod disposed in the hollow body, to which lubricant is applied before the rolling process, whereby this hot-rolling method is characterized in that the lubricant is applied into a matrix adapted to the rolling rod, and subsequently applied to the rolling rod.

The latter solution makes it possible, cumulatively or alternatively to the lubricant application in solid form, a controlled and controllable lubricant application, in which also, the risk of sudden evaporation of large amounts of fluid but also precise layer thickness control can easily take place, because ultimately, the matrix can easily be prepared and, in terms of fluid amount, also be adapted locally to the corresponding requirements, before the lubricant is transferred to the rolling rod, coming from the matrix. The latter process can then occur very quickly, so that the overall process is only insignificantly slowed down by this.

Using a corresponding matrix, the lubricant can be introduced into the matrix in solid form. For this purpose, individual or multiple layers of lubricant film can be laid into the matrix, for example. Likewise, however, liquid or fluidic lubricant can also be applied to the matrix, whereby in particular, the possibility exists to carry out this process thoroughly and over a longer period of time, so that it takes place in correspondingly controlled manner. In particular, in the case of liquid lubricants or lubricants that are applied to the matrix in connection with a liquid, evaporation or drying processes will take place, so that uncontrolled evaporation of these liquids, when they come into contact with the rolling rod, does not occur.

Depending on the concrete implementation, it is therefore possible, in this connection, that even fluidic lubricants, such as, in particular, suspensions or pastes, harden or are compressed by means of being pressed on, in such a manner that a self-supporting shaped body is formed in the matrix, which then, in accordance with the solution first mentioned, leads to the result that the lubricant is applied to the rolling rod in solid form. However, this is not absolutely necessary, as long as the lubricant is sufficiently stabilized in shape by means of the matrix; then, even non-self-supporting forms of lubricant can be applied over the matrix and, supported by the matrix, applied to the rolling rod in operationally reliable manner.

Accordingly, it is advantageous if, after the lubricant has been applied to the matrix, the lubricant is transferred from the matrix to the rolling rod, in that either the rolling rod is laid into the matrix, or the matrix is laid around the rolling rod. This particularly also allows suitable pressing of the lubricant onto the rolling rod, so that the lubricant remains on the rolling rod, in operationally reliable manner, even during the subsequent processes, such as, for example, during transport to the hot-rolling device or during introduction into the hollow body. In this connection, it is understood that corresponding pressing on or pressing down of the lubricant can also take place in another manner, as will be explained below.

In particular, the lubricant can be applied to the rolling rod in film or sheet form, as has already been indicated above. In this connection, in particular, precut parts can also be used, so that layer thickness variation of the lubricant can already be implemented, easily and in operationally reliable manner, during preparation. On the other hand, however, it is also possible to lay lubricant films or sheets into a matrix and to apply them to the rolling rod subsequently, as has already been explained above. In this connection, it should also be explained that corresponding thin bodies composed of lubricant, whether they are disposed within a matrix or preformed in some other manner, to be self-supporting, are referred to as films.

Lubricants in film or sheet form are also pressed onto or pressed down onto the rolling rod. When using a matrix, this takes place directly when the matrix is laid around the rolling rods or when the rolling rod is laid into the matrix. On the other hand, pressing on or pressing down can also take place by way of rollers or other modules.

Particularly if the lubricant present in film or sheet form is wound onto the rolling rod, the longitudinal tension in the corresponding lubricant material web that is applied for winding it on can already guarantee sufficient pressing on of the lubricant.

The above solutions bring about the result, in each instance, that the lubricant is applied to the rolling rod either in solid form, whether in film or sheet form or as a molded body, or whether in still fluidic, i.e. flowable form, supported by a matrix. In this way, particularly controlled and controllable lubricant application can be implemented, particularly without the risk of sudden evaporation of large amounts of liquids, or unintentional dripping of fluid components. In particular, depending on the concrete requirements, the layer thickness as well as the extent to which the lubricant is pressed on can be adapted to the existing requirements, depending on the concrete implementation of the present invention.

Accordingly, the present invention proposes, independent of the other characteristics of this invention, a method for hot-rolling of metallic, elongated hollow bodies by means of a rolling rod disposed in the hollow body, as a solution for the task stated above, whereby lubricant is applied to the rolling rod before the hot-rolling process, and the method is characterized in that the lubricant is pressed onto the rolling rod. By means of this pressing on, the risk of sudden evaporation as well as uncontrolled dripping of lubricant can be minimized, independent of the other characteristics of the invention. In this connection, "pressing on" is understood to mean an application of force with mechanical means, in the present case.

In this regard, a hot-rolling mill for hot-rolling of metallic, elongated hollow bodies by means of a rolling rod disposed in the hollow body is also proposed, whereby the hot-rolling mill has a hot-rolling device as well as a lubricant application station disposed ahead of it, and is characterized by an apparatus for pressing lubricant on. By means of this pressing on, simple control of the layer thickness can be guaranteed, particularly if the latter is supposed to be varied. In this connection, the layer thickness can be influenced in targeted manner, for example by means of lubricant sheets or films, or by means of damp powder, by means of sufficiently paste-like lubricant, or by corresponding mold matrices, whereby the press-on apparatus can comprise at least one lubricant application roller, which guarantees particularly controlled and controllable lubricant application. In particular, the risk of sudden evaporation of large amounts of liquid, as was already explained above, can be minimized in targeted manner.

Accordingly, it is also advantageous in process management if the lubricant is rolled on, which can particularly take place by means of rollers, but also by means of brushes or caterpillar chains, link chains, or prism chains, in other words chains that carry matrices. Since the latter device cannot be referred to as application rollers, it is accordingly advantageous if the press-on apparatus comprises at least one lubricant press, which can be implemented, for example, by means of the aforementioned chains, particularly prism chains, but also by means of conveyor belts.

As has already been explained above, films can also be applied to the rolling rod. Accordingly, it is advantageous if the press-on apparatus comprises at least one film winding apparatus. In this connection, the film tension can also serve for pressing on, if necessary, whereby—depending on the concrete implementation—a lubricant press or a corresponding press-on roller can also be provided, in order to be able to ensure sufficient press-on forces.

Independent of the other characteristics of the present invention, furthermore a hot-rolling mill for hot-rolling of metallic, elongated hollow bodies by means of a rolling rod disposed on the hollow body is proposed, whereby the hot-rolling mill comprises a hot-rolling device as well as a lubricant application station disposed ahead of it, and is characterized in that the lubricant application station has an apparatus for variation of the layer thickness of the lubricant along the rolling rod. Accordingly, a method for hot-rolling of metallic, elongated hollow bodies by means of a rolling rod disposed in the hollow body, to which lubricant is applied before the hot-rolling process, is proposed, whereby this method is characterized in that the layer thickness of the lubricant is varied along the rolling rod, during application.

By means of layer thickness variation, and, in particular, by means of layer thickness control, the layer thickness can be adapted to the individual needs. In particular, layer thickness variation can be provided over the axial expanse of the rolling rod, for example with a maximum at 0.3 times the rolling rod length. In this manner, the amount of lubricant can be minimized, thereby making it possible to optimize the overall costs for hot-rolling accordingly. Likewise, it is possible to provide a variation of the layer thickness particularly in the circumference direction around the rolling rod, particularly in the run-in region. This particularly takes the fact into account that in general, during hot-rolling, only selected regions come into contact with the rolling rod at a specific point in time, particularly at the beginning of the rolling process, even at the circumference. By means of a correspondingly adapted layer thickness of the lubricant, it can be ensured that only the amount of lubricant that is actually required is present at the corresponding locations.

In this connection, it is understood that the layer thickness, in particular, is also measured locally, and that the measurement result can be used for a regulation circuit for regulating the layer thickness. The latter particularly holds true even if fluidic lubricants, in other words paste-like, liquid, or powder-form lubricants are applied, because here, possible deviations from default values, as the result of minor disruptions, must be feared to a greater extent than is the case for solid lubricants.

In particular, the lubricant can be applied to the rolling rod in multiple layers. This can particularly take place also by means of different application methods, whereby as a result, more precise and easy layer thickness control as well as adaptation to individual requirements can take place, particularly even if the number of lubricant layers is selected to be locally different. In particular, the type of lubricant layers can also be adapted in accordance with the requirements, whereby it is also possible to apply different types of lubricants in different layers. In this connection, it is understood that multi-layer application of lubricant to the rolling rod is advantageous even independent of the other characteristics of the present invention, for a method for hot-rolling of metallic, elongated hollow bodies by means of a rolling rod disposed in the hollow body, to which rod lubricant is applied before the hot-rolling process. This is true particularly also as a distinction from EP 1 775 038 B1, in which lubricant is provided on the rolling rod, on the one hand, but in the hollow body, on the other hand, whereby in particular, the latter sets very high requirements with regard to lubricant application, because the corresponding hollow body has relatively high temperatures and the lubricant application must take place from the inside.

As was already indicated above, the lubricant layers can have different material properties, so that as a result, the lubrication behavior can be influenced in desired manner, whereby in particular, the lubricant layers can also be varied locally and adapted to the requirements.

Before lubricant application to the rolling rod, the lubricant can be provided with a functional agent. In this way, the risk of uncontrolled or sudden evaporation of any fluids can be minimized, because the functional agent, even if it is applied to the lubricant in liquid or powder form, has time to enter into a good connection with the lubricant before the lubricant itself, together with the functional agent, is applied to the rolling rod.

On the other hand, it is also possible to apply a layer of functional agent directly to the rolling rod before the lubricant application takes place. The latter is possible, in particular, without the risk of uncontrolled or sudden evaporation of liquid or without the risk of dripping of functional agent, if the functional agent is solid. If the functional agent is fluidic, then uniform application of lubricant can be ensured by means of the use of sheets or films as lubricant or by means of the use of shaped bodies as lubricants, or also by means of the suitable use of application apparatuses, such as rollers or matrices, even if the functional agent might possibly be applied to the rolling rod in uncontrolled manner or more or less uncontrolled manner. In concrete process management, however, it is also possible that application of the functional agent to the rolling rod takes place immediately before lubricant application, so that the time span in which the functional agent can react in uncontrolled manner is minimized.

Possible functional agents that can be used are, in particular, an adhesive, a binder, a release agent, such as lime or borax, and/or an insulation agent, particularly a thermal insulation agent. In this regard, any suitable additive material that must also be applied to the rolling rod can be used supplemental to the lubricant.

As was already indicated above, the risk of evaporation of liquid can be further minimized if the functional agent is also applied in solid form. In particular, the functional agent can be applied to the rolling rod in film or sheet form. Particularly if the functional agent does not have to be provided between lubricant and rolling rod, it is advantageous if the lubricant is applied directly to the rolling rod. In this regard, application of liquids or fluidic or flowable materials is refrained from before the lubricant comes into contact with the rolling rod. In this way, possible disadvantages, such as uncontrolled evaporation or displacement of some materials can be avoided because no such materials get onto the rolling rod before the actual lubricant application.

When using films, sheets, or molded bodies, whether these consist of lubricant and/or of functional agents, support materials such as cellulose or paper, to which the agents, in other words the lubricants and/or functional agents, are applied, can be used, particularly also as an alternative to reusable, generally metallic matrices, before these agents are applied to the rolling rod or introduced into the matrix. This makes it possible, even at very thin layer thicknesses, to form self-supporting structures for the lubricant or the functional agent, even if these layer thicknesses in themselves do not suffice to sufficiently stabilize the material. Depending on the concrete implementation, the support materials can be removed again and disposed of, or passed to reuse, after lubrication of the rolling rod or after introduction of the lubricant or the functional agent into the matrix. On the other hand, the support materials can also remain on the rolling rod and be lost, for example burned off, during rolling, whereby they can also be used as a functional agent, if necessary.

The use of solid lubricants, in particular, brings with it a low water or liquid content of the lubricants, and this might also be able to minimize aging processes.

The method according to the invention, but also the apparatus according to the invention, are particularly suitable for shells, pipes, or other elongated hollow bodies that are supposed to be hot-rolled using a rolling rod.

It is understood that the characteristics of the solutions described above and in the claims can also be combined, if necessary, in order to be able to implement the advantages cumulatively, accordingly.

Depending on the concrete implementation of the present invention, the following advantages can be implemented cumulatively or alternatively:

- improvement in the lubrication between rolling rod and rolled material;
- production of a lubricant thickness that is variable over the rolling rod length and adapted to the rolling rod stress;
- reduction in lubricant consumption, because lubricant control is optimal;
- reduction in environmental and workplace pollution, particularly by means of reduction in emissions from evaporating liquid or microdust pollution;
- establishment of structured or multi-layer lubricant layers and separating layers; and/or
- the risk of penetration of water into the work piece.

In the present invention, any type of lubricant that is suitable for hot-rolling can be used as lubricants. Layer-form graphite is particularly preferred, particularly if its electrical conductivity was lowered by means of known measures. Also, low-graphite or graphite-free lubricants are possible, particularly for high-alloy steels or special steels.

Figure 2:
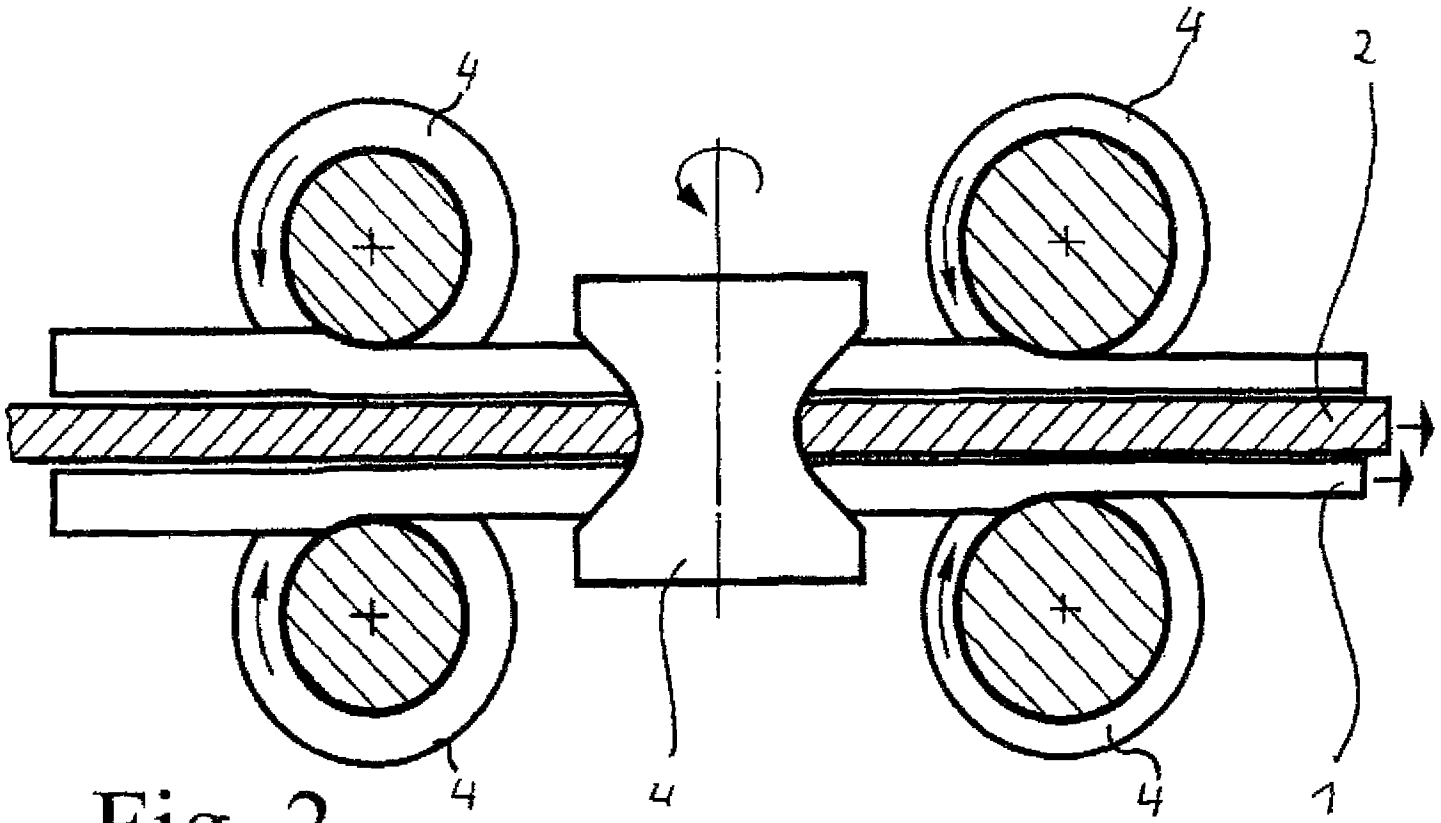
Figure 3:
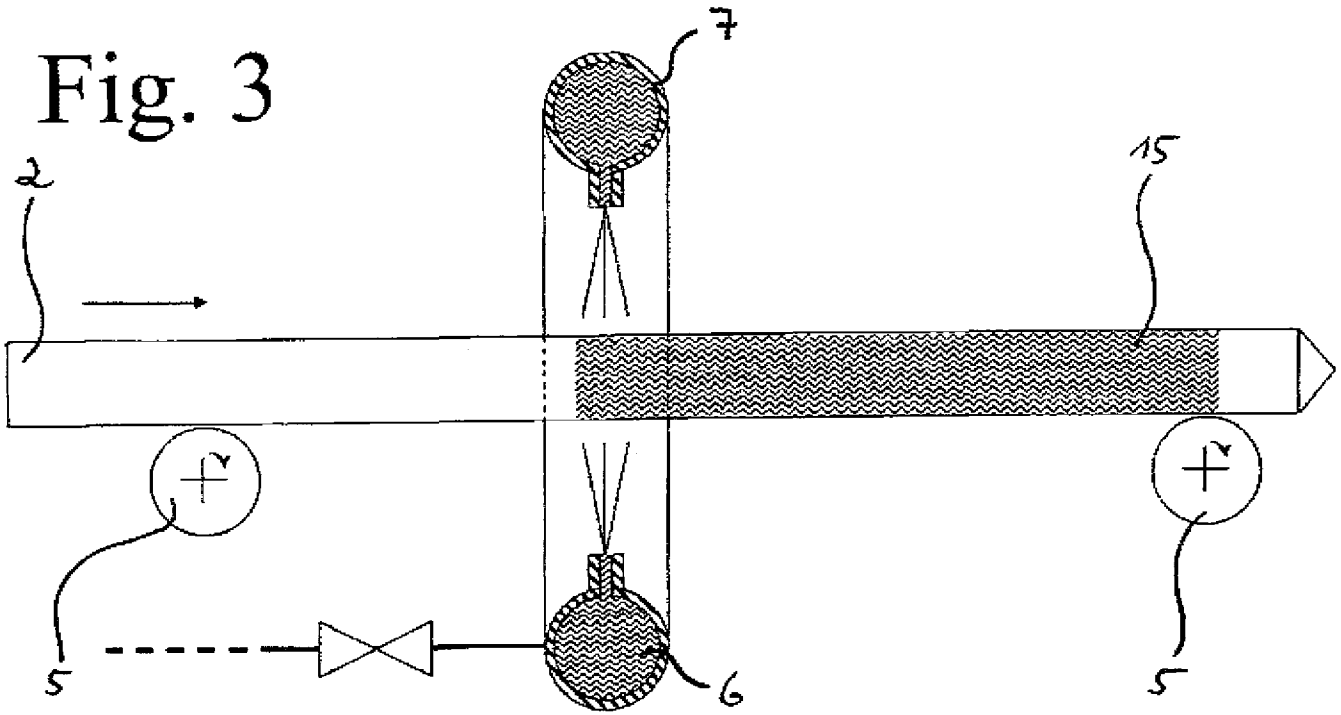
Figure 4:
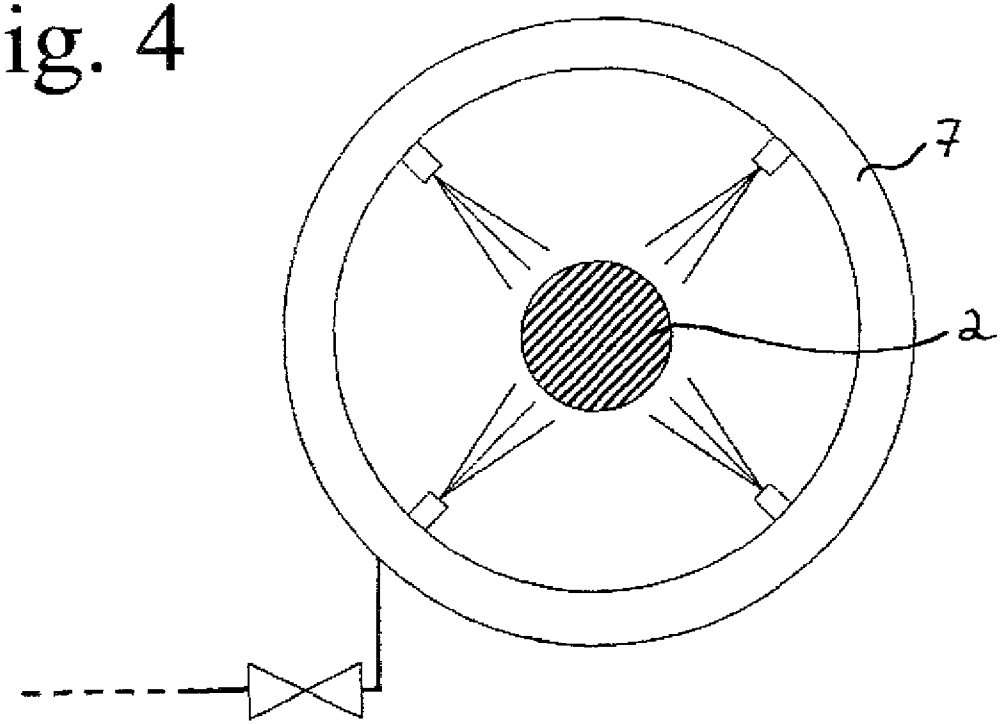
Figure 5:
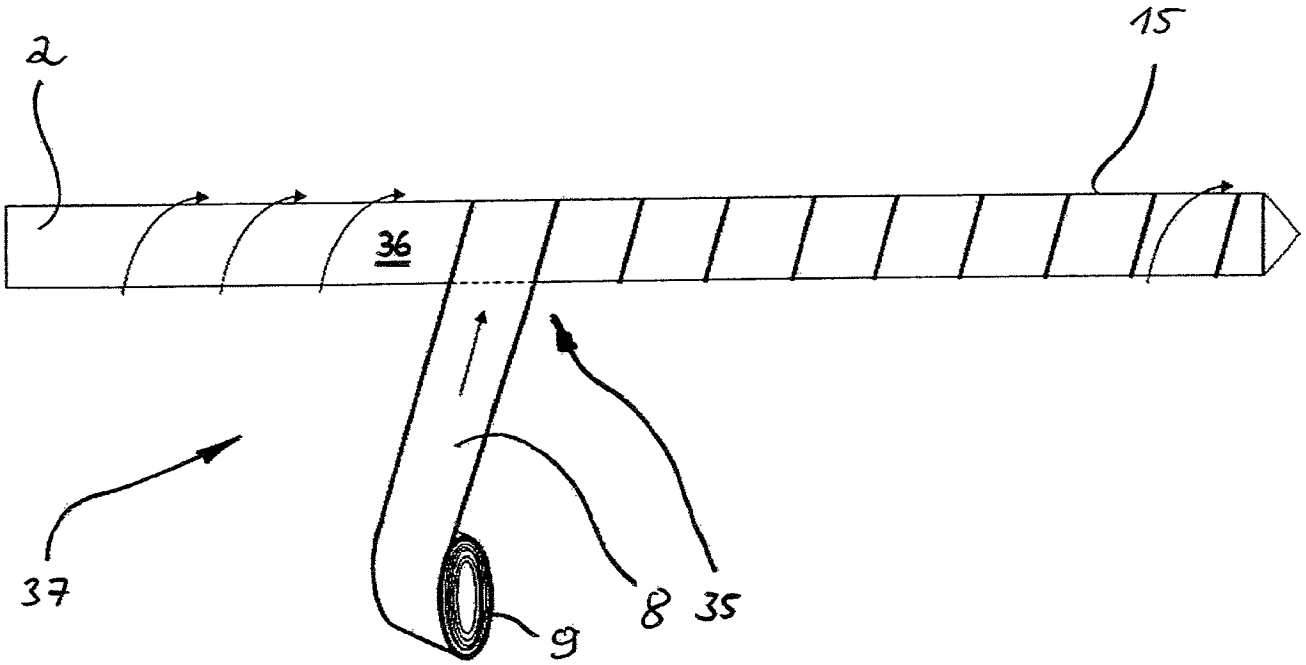
Figure 6:
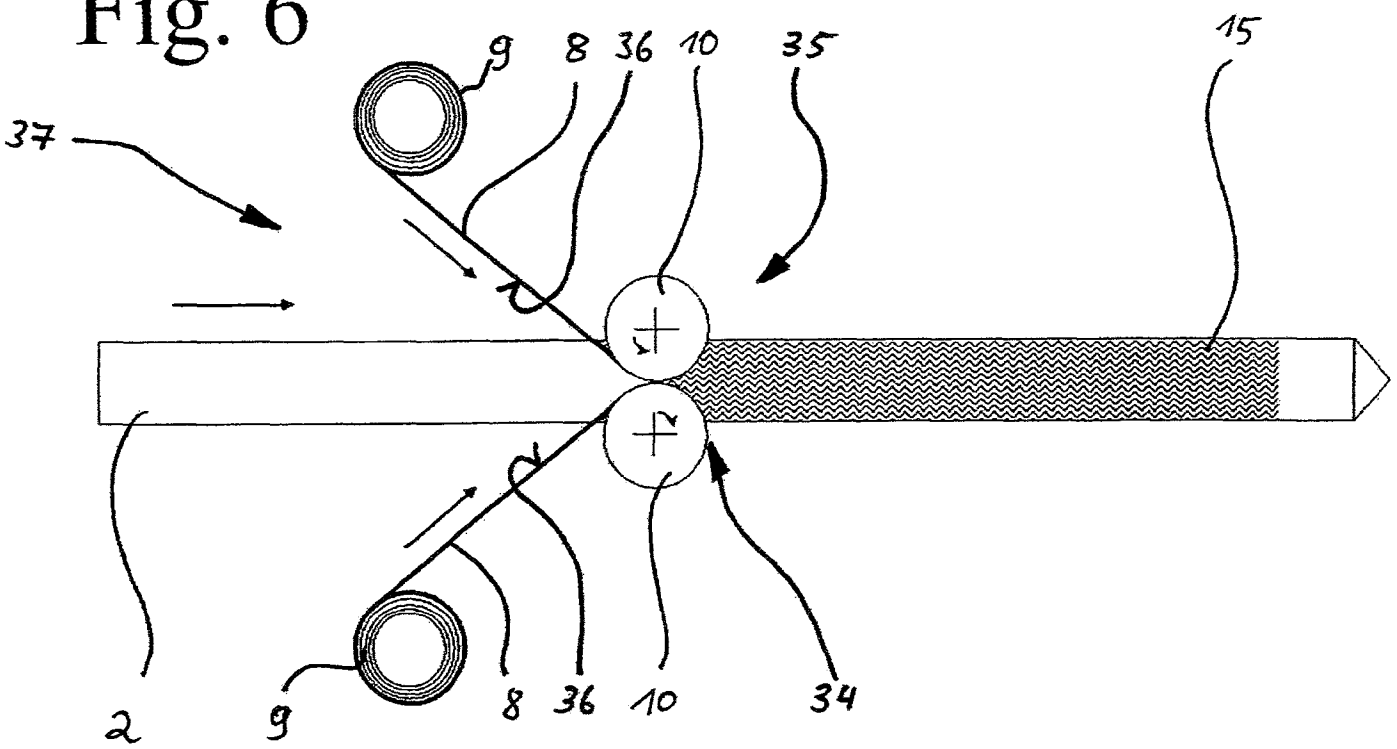
Figure 7:
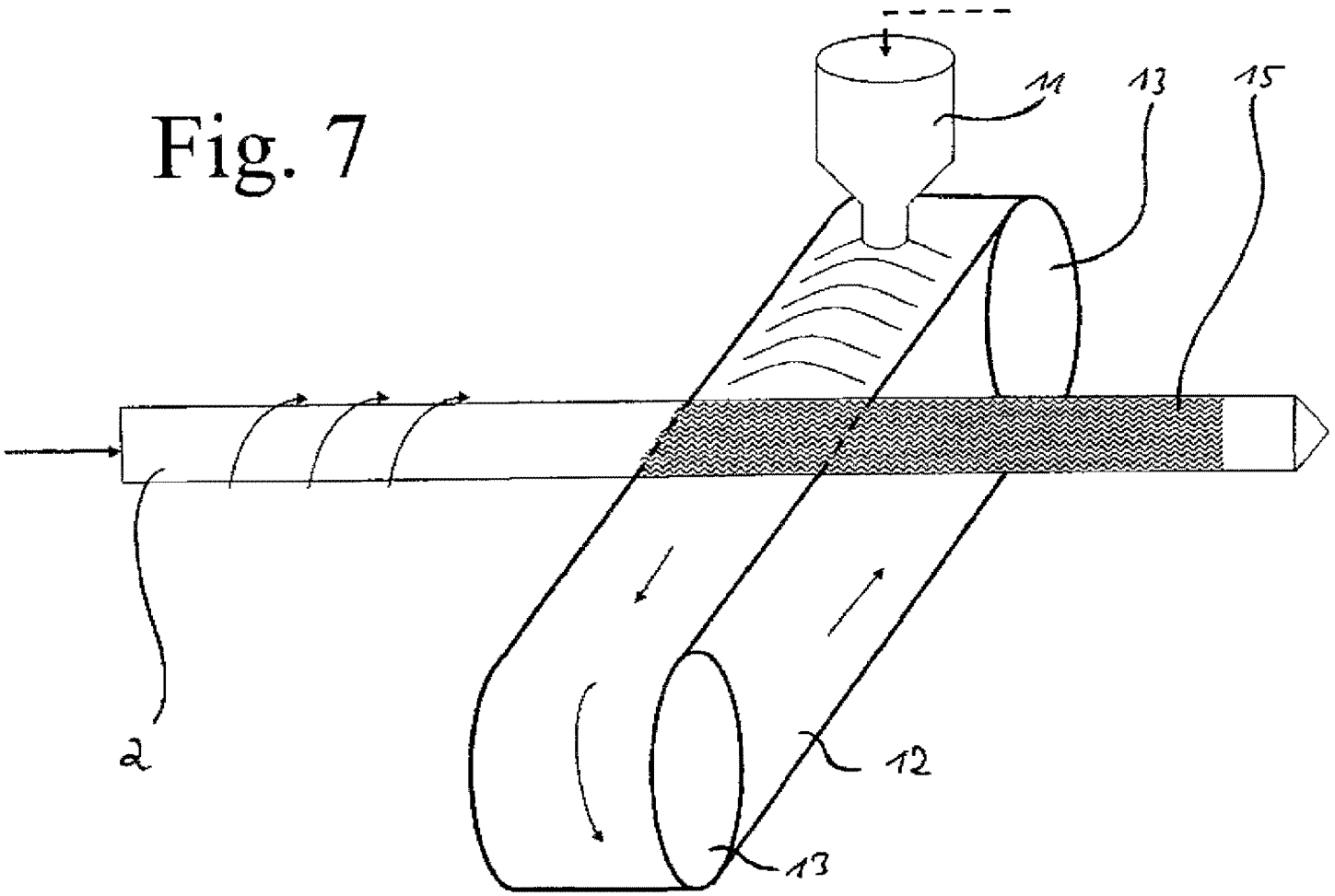
Figure 8:
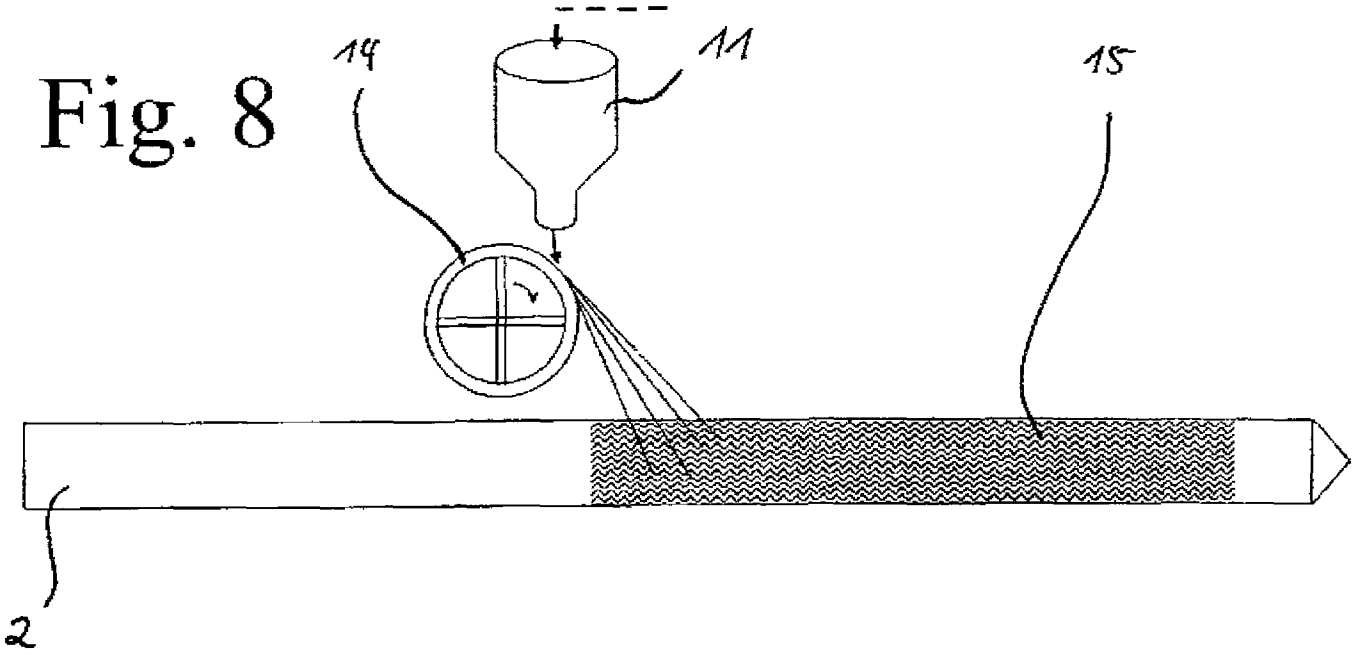
Figure 9:
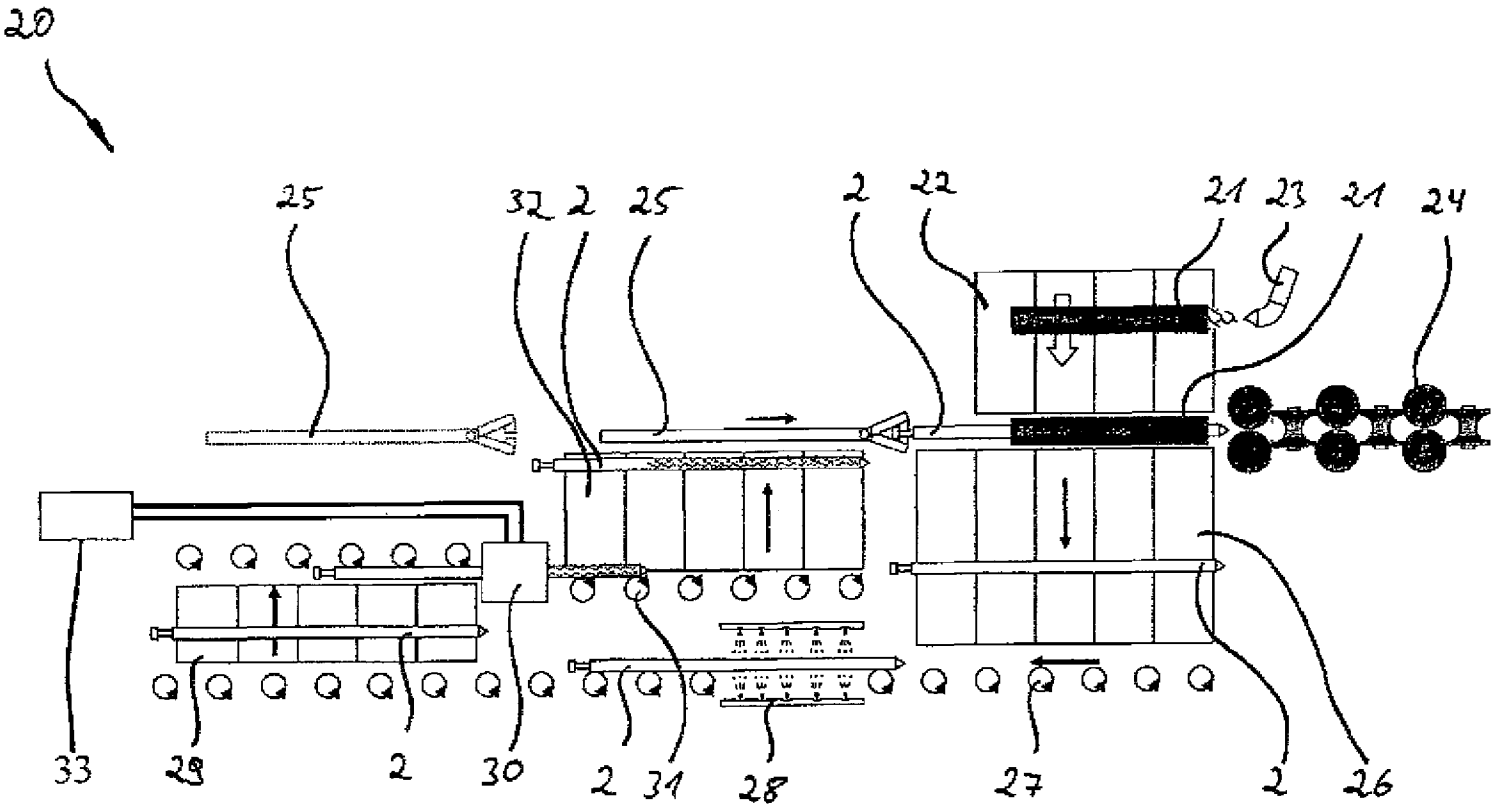
Figure 10:
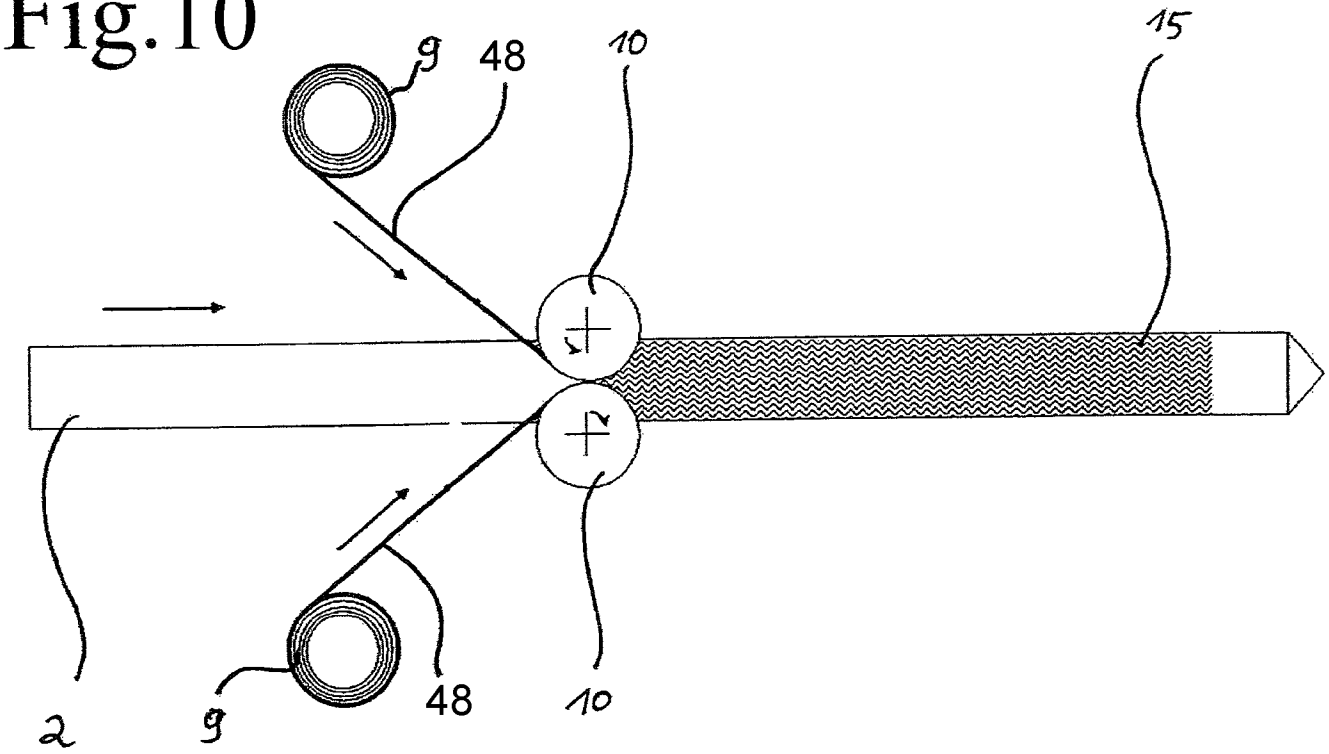
Figure 11:
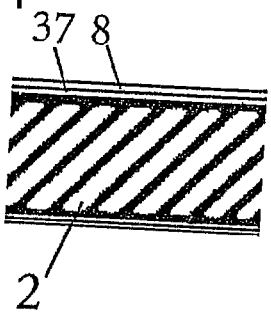
Figure 12:
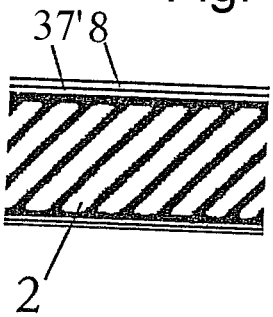
Figure 13:
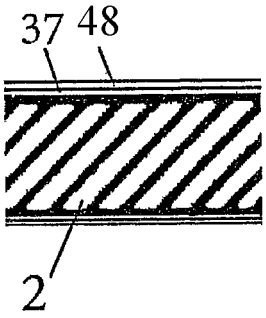
Figure 14:
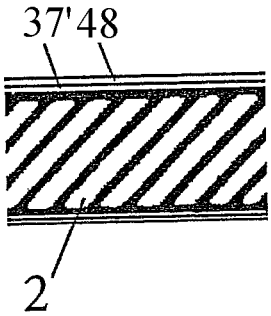

Further advantages, goals, and properties of the present invention will be explained using the following description of exemplary embodiments, which are particularly also shown in the attached drawing. The drawing shows:

FIG. 1 the principle of pipe-rolling with an internal rolling rod, in this case a cross-rolling method;

FIG. 2 the principle of pipe-rolling with an internal rolling rod, in this case a longitudinal rolling method;

FIG. 3 spraying on of a liquid lubricant dispersion, by means of a nozzle ring, in schematic longitudinal section;

FIG. 4 the arrangement, according to FIG. 3 in a sectional view through the rolling rod;

FIG. 5 coating of a rolling rod by means of winding on a lubricant film;

FIG. 6 rolling rod lubrication in which a lubricant film is unwound from rolls and pulled over the rolling rod longitudinally;

FIG. 7 pressing on of lubricant onto a rotating mandrel rod, by way of an application band;

FIG. 8 casting of lubricant powder onto a rolling rod;

FIG. 9 a rolling-rod cycle of a hot-rolling mill having a lubricant application station;

FIG. 10 rolling rod lubrication in which a lubricant sheet is unwound from rolls and pulled over the rolling rod longitudinally;

FIG. 11 a cross-sectional view through a rolling rod with a lubricant film and a functional agent film disposed between the lubricant film and the rolling rod;

FIG. 12 a cross-sectional view through a rolling rod with a lubricant film and a functional agent sheet disposed between the lubricant film and the rolling rod;

FIG. 13 a cross-sectional view through a rolling rod with a lubricant sheet and a functional agent film disposed between the lubricant film and the rolling rod; and FIG. 14 a cross-sectional view through a rolling rod with a lubricant sheet and a functional agent sheet disposed between the lubricant film and the rolling rod.

In hot-rolling of a work piece 1 by means of a rolling rod 2, as shown schematically in FIGS. 1 and 2, a hollow block, as the work piece 1, in which a corresponding rolling rod 2 is disposed, is guided past rollers, whether cross-rollers 3 (see FIG. 1) or longitudinal rollers 4 (see FIG. 2), whereby the rollers 3, 4 form the work piece 1 accordingly, in the direction toward the rolling rod 2, which accordingly exerts a counter-pressure to the rollers 3, 4, so that after rolling, an elongated internal opening in the work piece 1 remains. In this connection, however, the rolling rod 2 enters into interaction with the work piece 1 not with pressure but rather in sliding or rubbing manner. Accordingly, a lubricant is generally provided between work piece 1 and rolling rod 2, in order to accordingly reduce the stress both for the work piece 1 and for the rolling rod 2. Also, it must be taken into consideration that such rolling processes take place at relatively high temperatures, particularly also at temperatures above 1000° C.

In this connection, it is known from the state of the art to apply a lubricant dispersion 6 onto a rolling rod 2 from a nozzle ring 7, which rod is being guided past the nozzle ring 7 by means of transport rollers 5, for example (see FIGS. 3 and 4), in order to make a corresponding lubricant layer 15 available. However, corresponding suspensions have the disadvantage that the solvent can evaporate in uncontrolled manner on the hot rolling rod 2, so that—in order to ensure a sufficient amount of lubricant—a relatively large amount of lubricant must be sprayed on. Furthermore, there is the risk that the lubricant will evaporate as friction wear after evaporation of the solvent, and therefore will no longer be available for the rolling process. This is remedied, according to the state of the art, in that dry powder, directed over an electrical field, is supposed to be applied. However, it is not possible to eliminate the risk of uncontrolled friction wear in this way. Likewise, targeted application continues to be very difficult, particularly since the electrical field is very difficult to control and to maintain in the desired manner under actual operating conditions. In the present case, this is ensured by means of control of the lubricant layer, not shown, by means of which the layer thickness of the lubricant is measured before introduction of the lubricated rolling rod 2 into the hollow block 1, and then the throughput through the nozzle ring 7 is acted on to regulate it, in order to be able to compensate for possible losses caused by friction wear or dropping off.

As shown in FIG. 5 for example, the press-on apparatus may include at least one film winding apparatus 37. By means of the use of a lubricant film 8 (see FIG. 5), which is applied to the rolling rod 2 from a supply roll 9, to form a lubricant layer 15, this disadvantage can be countered, also in simple and operationally reliable manner. Because the lubricant is applied in solid form, the risk of uncontrolled evaporation of liquid does not exist. Likewise, the risk of uncontrolled friction wear can be minimized by means of this solid form. In this connection, it is understood, as is directly evident from FIG. 5, that the lubricant film 8 can be wound around the rolling rod 2 in spiral shape, with joined edges. Likewise, however, an overlap or a certain gap between the individual windings can remain, thereby making it possible to control the amount of lubricant in targeted manner, and also to vary it locally. Likewise, it is obvious that in this manner, multiple layers, particularly also multiple layers of different lubricant films 8, can accordingly be wound onto the rolling rod 2. It is also understood that the lubricant film 8 can be provided with a functional agent 36, such as a binder, an adhesive, or the like, before being wound on—depending on the requirements. In this connection, the lubricant film 8 can also be configured to be self-adhesive, or a suitable adhesive is applied to the rolling rod 2 in advance. Likewise, it is possible that the lubricant film 8 comprises a support layer, for example composed of paper, cellulose, or the like, whereby—if necessary—the support layer can also be pulled off after the lubricant has been applied to the rolling rod 2, if the lubricant layer then remains on the roller rod 2 with sufficient inherent stability, something that can be guaranteed by means of a suitable adhesive or also by means of pressing it on.

As shown as an example in FIG. 6, the lubricant film 8 can also be unwound longitudinally from a supply roll 9 and applied to the rolling rod 2, for example by means of two half-round rollers 10, whereby in the exemplary embodiment according to FIG. 6, the work is done with two separate lubricant films 8, which are applied on both sides, by means of an application roller 10 each. Likewise, further supply rolls 9 with lubricant films 8 can be disposed around the rolling rod 2, and can interact with corresponding application rollers 10. Also, it is possible that only one lubricant film 8 runs off from a supply roll 9, which is then laid around the rolling rod 2 by means of rollers or also corresponding nozzles. In an alternative implementation, the lubricant film 8 can first be formed into a tube and subsequently pulled onto or pulled over the rolling rod 2. Lubricant may be applied to a matrix 34 shown in FIG. 6 adapted to the rolling rod 2 and subsequently applied to the rolling rod 2.

In the case of the latter implementations, in particular, it is possible that films having a varying layer thickness are used, so that a varying layer thickness profile of the lubricant layer 15 is directly applied to the rolling rods. In this connection, the application rollers 10 form an apparatus 35 for varying the layer thickness of the lubricant along the rolling rod 2. On the other hand, it is understood that a corresponding profile can also be made available by means of multiple layers that are applied or put on.

As is directly evident, the application rollers 10 bring about the result, in the exemplary embodiment according to FIG. 6, that the lubricant film 8 is pressed onto or pressed down onto the rolling rod 2, thereby making it possible to minimize the risk that lubricant is lost in uncontrolled manner. However, the latter can also be used advantageously in the implementation according to FIG. 5, but also when using a tube, analogously.

However, such mechanical pressing on or pressing down can also be advantageously utilized—in accordance with the exemplary embodiment shown in FIG. 7—in the case of fluidic lubricants, for example in the case of dry or at most slightly moistened lubricant powders, but also in the case of a corresponding paste-like material. For this purpose, the fluidic lubricant is applied to an application band 12, for example from a lubricant supply 11; this band runs by way of deflection rolls 13. In this connection, the application band 12 is disposed at a slight incline relative to the movement direction of the rolling rod 2, which rolls over the application band 12, so that the lubricant is pressed onto the rolling rod 2. In this manner, the lubricant can be applied to the rolling rod 2 in targeted and operationally reliable manner, at minimal loss. The layer thickness can be controlled, on the one hand, by means of the speed of the application band 12, by means of the take-off speed from the lubricant supply 11 and/or by means of the slanted position between rolling rod 2 and application band 12.

Flowable lubricant can also, as shown as an example in FIG. 8, be applied to a rolling rod 2 from a supply container 11 by way of a slinger wheel 14, whereby this slinger wheel 14 is preferably provided in an enclosed space, in order to minimize exit of lubricants and contamination of the workplace in this manner. Also in the case of such an embodiment, as is furthermore true for the other aforementioned embodiments, it is possible to measure the lubricant thickness of the lubricant layer 15, in order to thereby adapt the lubricant thickness locally to the desired requirements.

In this connection, it is understood that, in particular also in the implementations according to FIGS. 5, 7, and 8, the lubricant can be mixed with a corresponding functional agent, which has adhesive properties or other properties, in order to promote adhesion to the rolling rod 2. Furthermore, it is understood that in place of a moving application band 12, application rollers that lie against the rolling rod 2, similar to the application rollers 10 of the example of use according to FIG. 6, can be used. Likewise, other or further devices that have a press-down effect, such as nozzle arrangement or link chains or prism chains, can be used accordingly; these can also serve as application devices, if necessary. Also, it is possible to apply the lubricant to the rolling rod 2 by way of brushing.

In the case of a hot-rolling mill 20, as explained as an example in FIG. 9, using a Konti roller train, a perforated hollow block is first dragged to a deoxidation system 23 by way of transverse transport 22. There, loose scale on the interior surface of the hollow block 21 is blown out, and a borate and/or phosphate powder is blown in to dissolve adhering scale. It is understood that depending on the concrete implementation of the present invention, alternative or further measures can be provided at this point.

Subsequently, the hollow block 21 is positioned in front of a corresponding rolling mill 24 (here a longitudinal rolling mill), and a rolling rod 2 coated with lubricant is pushed into the hollow block 21. The latter takes place, in the case of this embodiment, by way of a retention apparatus 25 that positions the rolling rod 2 accordingly and holds it in place also during the subsequent rolling process. In other implementations of the present invention, the rolling rod 2 can rotate freely, without retention, whereby then, preferably, a corresponding positioning device is provided for the roller rod 2, in order to introduce the rod into the hollow block 1 and continue to convey it, if necessary.

After rolling, the rolling rod 2 is retracted and moved out of the roiling line by way of transverse transport 26. After the transverse transport, the rolling rod 2 is conveyed through a cooling device 28, by way of roller conveyors 27, in the case of this exemplary embodiment, and there cooled to the temperature required for subsequent lubrication. Depending on the concrete implementation of the present invention, it is also possible to do without separate cooling, if necessary.

After cooling, the rolling rod 2 is once again transported transversely in a transverse transport 29, and passed to a lubricant application station 30 according to the invention, which is connected, in the case of this exemplary embodiment, with a separate lubricant prefabrication station 33, from which prefabricated lubricant is made available, being kept on hand. In this exemplary embodiment, the hot-rolling mill 20 and the lubricant prefabrication station 33 do not work synchronous with one another, whereby it is understood that in other embodiments, synchronous work or even doing without such separate lubricant prefabrication can be provided, if necessary. The latter lubricant application station 30 can be any one of the application stations described above, or can implement any one of the application methods described above.

After lubrication, the rod is transported to a waiting position, by way of further roller conveyors 31 or by way of a further transverse transport 32, from which position it can be picked up by the retention device 25, if this has been moved back (shown with a dotted line) and introduced into a hollow block 21 that has been made available.

It is understood that such a cycle for rolling rod lubrication can deviate in details from the exemplary embodiment described above, without deviating from the basic idea of the present invention.

FIG. 10 shows a rolling rod lubrication similar to that shown in FIG. 6 but with a lubricant in the form of a sheet 48, e.g. a graphite sheet, being pulled over and then pressed onto the rolling rod 2 longitudinally via the rollers 9 and 10.

FIGS. 11-14 show cross-sectional views through a rolling rod 2 with a lubricant film 8 or a lubricant sheet 48 disposed on the rolling rod 2 and with a functional agent film 37 or a functional agent sheet 37' being disposed between the lubricant film or sheet 8, 48 and the rolling rod 2.

REFERENCE SYMBOL LIST

1 work piece
2 rolling rod
3 cross-rolling
4 longitudinal rollers
5 transport roller
6 lubricant dispersion
7 nozzle ring
8 lubricant film
9 supply roll
10 application roller
11 lubricant supply
12 application band
13 deflection roll
14 slinger wheel
15 lubricant layer
20 hot-rolling mill
21 hollow block
22 transverse transport
23 deoxidation system
24 rolling mill
25 retention device
26 transverse transport
27 roller conveyor
28 cooling device
29 transverse transport
30 lubricant application station
31 roller conveyor
32 transverse transport
33 lubricant fabrication station

The invention claimed is:

1. A method for hot-rolling a metallic, elongated hollow body, said method comprising:
- disposing a rolling rod in the hollow body;
- providing a solid lubricant as a lubricant film;
- applying the lubricant film in solid form to the rolling rod; and
- subsequently hot rolling the hollow body after the lubricant film is applied in solid form to the rolling rod;
- wherein a first roller disposed adjacent to the rolling rod presses the lubricant film onto the rolling rod; and
- wherein:
  - a functional agent is provided as a functional agent film or as a functional agent sheet and the functional agent film or the functional agent sheet is applied in solid form to the rolling rod or to the lubricant film before the lubricant film is applied in solid form to the rolling rod.

2. The method according to claim 1, wherein before the lubricant film is applied in solid form to the rolling rod, the lubricant film is prefabricated.

3. The method according to claim 2, wherein the lubricant film is prefabricated in a fabrication station and the lubricant film is applied to the rolling rod in a lubricant application station, the lubricant application station being disposed separate from the fabrication station.

4. The method according to claim 1, wherein the lubricant film is rolled onto the rolling rod via the first roller.

5. The method according to claim 1, wherein the lubricant film has a varying layer thickness along the rolling rod.

6. The method according to claim 1, wherein the lubricant film is applied to the rolling rod in multiple layers.

7. The method according to claim 6, wherein the lubricant layers have different material properties.

8. The method according to claim 1, wherein the functional agent film or the functional agent sheet is applied to the lubricant film before application of the lubricant film to the rolling rod.

9. The method according to claim 8, wherein the functional agent comprises an adhesive, a binder, a release agent or an insulation agent.

10. The method according to claim 1, wherein the functional agent film or the functional agent sheet is applied to the rolling rod before application of the lubricant film to the rolling rod.

11. The method according to claim 1, wherein the elongated hollow body comprises a shell or a pipe.

12. The method according to claim 1, wherein the lubricant film comprises graphite.

13. The method according to claim 1, wherein the lubricant film comprises a support material.

14. The method according to claim 13, wherein the support material is lost during the rolling process.

15. The method according to claim 1, wherein the elongated hollow body comprises steel.

16. The method according to claim 1, wherein a second roller disposed adjacent to the rolling rod presses the lubricant film onto the rolling rod.

17. The method according to claim 1, wherein the first roller is a half-round roller.

18. A method for hot-rolling a metallic, elongated hollow body, said method comprising:

disposing a rolling rod in the hollow body;

providing a solid lubricant as a graphite lubricant sheet;

applying the graphite lubricant sheet in solid form to the rolling rod; and subsequently hot rolling the hollow body after the graphite lubricant sheet is applied in solid form to the rolling rod;

wherein a first roller disposed adjacent to the rolling rod presses the graphite lubricant sheet onto the rolling rod; and wherein:

a functional agent is provided as a functional agent film or as a functional agent sheet and the functional agent film or the functional agent sheet is applied in solid form to the rolling rod or to the graphite lubricant sheet before the graphite lubricant sheet is applied in solid form to the rolling rod.

19. The method according to claim 18, wherein before the graphite lubricant sheet is applied in solid form to the rolling rod, the graphite lubricant sheet is prefabricated.

20. The method according to claim 19, wherein the graphite lubricant sheet is prefabricated in a fabrication station and the graphite lubricant sheet is applied to the rolling rod in a lubricant application station, the lubricant application station being disposed separate from the fabrication station.

21. The method according to claim 18, wherein the graphite lubricant sheet is rolled onto the rolling rod via the first roller.

22. The method according to claim 18, wherein the graphite lubricant sheet has a varying layer thickness along the rolling rod.

23. The method according to claim 18, wherein the graphite lubricant sheet is applied to the rolling rod in multiple layers.

24. The method according to claim 23, wherein the lubricant layers have different material properties.

25. The method according to claim 18, wherein the functional agent film or the functional agent sheet is applied to the graphite lubricant sheet before application of the graphite lubricant sheet to the rolling rod.

26. The method according to claim 25, wherein the functional agent comprises an adhesive, a binder, a release agent or an insulation agent.

27. The method according to claim 18, wherein the functional agent film or the functional agent sheet is applied to the rolling rod before application of the graphite lubricant sheet to the rolling rod.

28. The method according to claim 18, wherein the elongated hollow body comprises a shell or a pipe.

29. The method according to claim 18, wherein the graphite lubricant sheet comprises a support material.

30. The method according to claim 29, wherein the support material is lost during the rolling process.

31. The method according to claim 18, wherein the elongated hollow body comprises steel.

32. The method according to claim 18, wherein a second roller disposed adjacent to the rolling rod presses the graphite lubricant sheet onto the rolling rod.

33. The method according to claim 18, wherein the first roller is a half-round roller.

* * * * *